US009156642B2

(12) United States Patent
Dunham et al.

(10) Patent No.: US 9,156,642 B2
(45) Date of Patent: Oct. 13, 2015

(54) SYSTEMS AND METHODS FOR IMPLEMENTING UNIQUE OFFSETTING STACKER REGISTRATION USING OMNI-DIRECTIONAL WHEELS FOR SET COMPILING IN IMAGE FORMING DEVICES

(71) Applicant: XEROX Corporation, Norwalk, CT (US)

(72) Inventors: Brian J. Dunham, Webster, NY (US); Carlos M. Terrero, Ontario, NY (US); Michael J. Linder, Walworth, NY (US); Randy R. Sprague, Webster, NY (US); Roberto A. Irizarry, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 97 days.

(21) Appl. No.: 14/170,312

(22) Filed: Jan. 31, 2014

(65) Prior Publication Data

US 2015/0217958 A1 Aug. 6, 2015

(51) Int. Cl.

| | |
|---|---|
| ***B65H 31/36*** | (2006.01) |
| ***B65H 31/26*** | (2006.01) |
| ***B65H 9/00*** | (2006.01) |
| ***B65H 1/04*** | (2006.01) |
| ***B65H 5/06*** | (2006.01) |
| ***B65H 7/14*** | (2006.01) |
| ***B65H 7/20*** | (2006.01) |
| ***G03G 15/00*** | (2006.01) |
| ***B65H 31/34*** | (2006.01) |
| ***B65H 9/16*** | (2006.01) |

(52) U.S. Cl.

CPC ..... *B65H 9/002* (2013.01); *B65H 1/04* (2013.01); *B65H 5/068* (2013.01); *B65H 7/14* (2013.01); *B65H 7/20* (2013.01); *B65H 9/166* (2013.01); *B65H 31/26* (2013.01); *B65H 31/34* (2013.01); *B65H 31/36* (2013.01); *G03G 15/6582* (2013.01)

(58) Field of Classification Search

CPC ..... B65H 31/36; B65H 31/34; B65H 31/26; B65H 9/166; B65H 9/002; B65H 29/22

See application file for complete search history.

(56) References Cited

U.S. PATENT DOCUMENTS

| | | | | |
|---|---|---|---|---|
| 4,589,654 A * | 5/1986 | Kanoto | ..... | 271/314 |
| 5,065,998 A * | 11/1991 | Salomon | ..... | 271/251 |
| 5,338,022 A * | 8/1994 | Funk et al. | ..... | 271/184 |
| 6,059,284 A * | 5/2000 | Wolf et al. | ..... | 271/227 |
| 8,240,665 B2 * | 8/2012 | Fujita | ..... | 271/226 |

* cited by examiner

*Primary Examiner* — Luis A Gonzalez

(74) *Attorney, Agent, or Firm* — Ronald E. Prass, Jr.; Prass LLP

(57) ABSTRACT

A system and method are provided for improving stack integrity for a set of image receiving media substrates at an output of a compiler in an image forming device by positioning a particularly configured substrate handling device downstream of the output of the compiler in a process direction. The substrate handling device is configured of a plurality of omni-directional wheeled devices that provide drive (traction) normal to a motor axis under control of one of a respective plurality of independent motors while allowing sliding in the motor axis direction. The omni-directional wheeled devices, in one embodiment, are configured with small roller wheels along the periphery of the wheel. When using three or more omni-directional wheeled devices, translational movement can be combined with rotation to deliver sheets of image receiving media exiting the compiler at a correct angle and lateral position for further processing.

21 Claims, 4 Drawing Sheets

SYSTEMS AND METHODS FOR IMPLEMENTING UNIQUE OFFSETTING STACKER REGISTRATION USING OMNI-DIRECTIONAL WHEELS FOR SET COMPILING IN IMAGE FORMING DEVICES

BACKGROUND

1. Field of Disclosed Subject Matter

This disclosure relates to systems and methods for improving stack registration with regard to sets of image receiving media substrates at an output of an image receiving media processing or post-processing unit in an image forming device by employing one or more omni-directional wheeled device structures to implement substrate support and substrate set alignment in two dimensions in the image forming device.

2. Related Art

Many modern image forming devices are comprised of myriad discrete component sub-systems. These discrete component sub-systems include (1) image receiving media supply components at an input end of the image forming device, (2) pre-processing and/or conditioning components for preparing surfaces of the image receiving media substrates to receive marking material to form images, (3) a marking material delivery component for depositing marking materials on the surfaces of the image receiving media substrates to form the images according to input or read image signals, (4) fusing/finishing components for fixing the deposited marking materials on the image receiving media substrates, and (5) post-processing devices for carrying out certain post processing tasks including compilers for collating the image receiving media substrates as sets comprising multi-page finished documents, for example, for stapling or otherwise binding the multi-page finished documents.

The individual component sub-systems are generally interconnected by a series of increasingly intricate image receiving media substrate transport sub-systems, paths and/or components. The image receiving media transport sub-systems, paths and/or components are generally designed and implemented in particular office-sized image forming devices in a manner that manages a size footprint for the image forming devices while not specifically limiting the transport requirements from an output of one component sub-system to an input of another component sub-system.

At an end of the processing scheme, the form and function of the image receiving media transport sub-systems, paths and/or components often become somewhat more narrowly defined. The print job is generally completed with individual sheets of image receiving media substrates, with the images formed and fixed thereon, being collected in sets at a compiler tray that may be associated with one or more of the post-processing sub-systems. Manipulation of the individual image receiving media substrates, or of the sets of image receiving media substrates, at that point in the processing of the documents responsive to the directed print job can be particularly intricate. There is often a need to ensure that the sets of image receiving media substrates are fairly precisely handled, stacked, and/or registered in order to facilitate one or more post-processing or finishing processes including, for example, stapling or binding.

SUMMARY OF THE DISCLOSED EMBODIMENTS

Operating and processing speeds for completing intricate print jobs in complex image forming systems continue to increase. The demands for precision in registration and alignment of sets of documents remain very high. This combination of factors places ever increasing stress on rapidly linearly reciprocating components in conventional systems, such as, for example, side tampers, causing mechanical components to fail. To address these issues, image forming device manufacturers have begun exploring a range of alternative solutions.

In a currently-implemented solution as a sheet of image receiving media substrate is ejected from a processing unit, a scuffer component may drive the sheet to a registration wall to establish registration in a process direction. The scuffer is then lifted so that mechanical paddle tampers can effect registration of the sheet in a cross-process direction. This process is repeated until an entire set is compiled and ready for stapling. In typical configurations, a compiler shelf at a throat of an image processing or prost-processing component may be generally raised relative to an elevator component, which lies downstream of the compiler shelf in a process direction and upon which compiled sets will ultimately be deposited. This configuration creates what is referred to as the "drop off." This uneven relative positioning provides clearance for the set clamp/ejector that will deposit the set onto the stack and, for example, serves to ensure that the staples in the ejecting set do not catch on a top edge of an already established stack in a manner that would upset set-to-set registration in the stack that is already on the elevator.

The geometry of this solution appears as follows. Image forming devices and image forming systems, particularly for use in an office environment, employ internal vertical compilers which involve some measure of compromise with regard to internally compiled set integrity. In many conventional configurations, a trail edge of individual image receiving media substrates being compiled as a set rests nominally in a range of 7-30 mm below a lead edge in the compiler throat. A disadvantageous result of this vertical compiler configuration then is that, when side tamping is applied to a compiled set image receiving media substrate, bottom sheets are often caused to "walk back." This walk back further results in poor in-set registration in a process direction. Additionally, as small stapled sets (<20 sheets) of image receiving media substrates build-up on an accumulated stack of sets below, the increased thickness due to the stapling can eventually build to a point where the stack interferes with the compiling sets, requiring moving the accumulated stack vertically lower causing further height differential and exacerbating the drop off problem.

As previously mentioned the scuffer lifts during the tamping operation executed on the stack in the cross-process direction to allow the sheet(s) to be moved, or otherwise manipulated, by the mechanical tampers in the cross-process direction. In this process, and because there is no mechanical barrier or otherwise engaged drag component that may constrain movement away from the registration walls during tamping, particularly when there is an increasingly large accumulated drop off to the main stack, the sheets being compiled can drift away from the registration walls or "walk back."

Previous methods that have been applied to attempt to address and alleviate compiler congestion issues and walk back issues resulting from the above-described differential stacking heights have included the use of compiler shutters on a basic finisher module (BFM). A difficulty with these currently-attempted "solutions" is that operating and processing speeds for completing print jobs in the involved image forming devices continue to increase. The demands for precision in registration and alignment of sets of documents remain very high. This combination of factors places ever increasing stress on conventional linearly reciprocating component systems causing mechanical components to fail. Also, as linearly reciprocating mechanical components, including compiler shutters, are caused to move at increased speeds, greater disturbances may be introduced that may adversely affect the efforts to precisely align the stacks of image receiving media substrates comprising each set. Abrupt movements of the shutters, for example, may cause the image receiving media substrates to be displaced slightly with the movement of the shutters as described above. The conventional shutter-based configurations are considered not to be able to work effectively in certain devices due to increasing productions speed requirements.

In recognition of these shortfalls with linearly moving devices, design efforts have begun to focus on innovative use of rotating components. Efforts to effect more "agile" registration have produced effective results by steering sheets using two independently driven nip rollers. The use of two independently driven rolls in certain systems has been effectively employed to provide skew, lateral and coarse process registration. In embodiments, the employed registration rolls may actually consist of three nips, two of which engage the sheet depending on the sheet cross-process size. Outer nips are used for large sheets by disengaging the center roll via a nip release mechanism. For smaller sheets, the center roll and one of the outer rolls are engaged. In other embodiments, independent drive rolls are used to adjust skew, while lateral correction is completed via a translating (cross-process) carriage.

It may be advantageous to continue improving media registration for future products and address the deficiencies of the current system to improve capabilities. For example, limitations on a capacity for multiple drive roll systems to deal with higher tangential forces cause those systems to lose certain effectiveness when handling faster sheet speeds, larger sized sheets and larger weight sheets. Certain systems acknowledge this difficulty in providing predetermined reductions in operating capacity/speed when dealing with extra large format sheets. The systems that employ translating carriages are also limited to a theoretical maximum speed due to the return time of the carriage (mass of carriage including motors, rollers and other drive elements) to a null, or neutral position for sheet-to-sheet registration.

It would be further advantageous in view of the above-noted image receiving medium handling difficulties arising from increasingly high speed document preparation requirements and the need to provide precise in-set and set-to-set registration to continue to refine media handling solutions beyond those currently available.

Exemplary embodiments of the systems and methods according to this disclosure may employ uniquely-configured and independently-operated omni-directional wheel components to facilitate improved sheet registration in image forming devices.

In embodiments, omni-directional wheel components are configured that provide drive (traction) normal to a motor axis while allowing sliding in the motor axis direction. In this regard, these components are configured to provide drive in the same way as regular wheel, but are able to facilitate free sliding in a perpendicular direction.

Exemplary embodiments may provide omni-directional wheel components that include small roller wheels arrayed about a periphery of the wheel. In embodiments, when using three or more of the disclosed omni-directional wheel components, translational movement can be combined with rotation to deliver sheets at a correct angle and lateral position.

Exemplary embodiments may provide a mechanism for correcting angular and lateral positioning by independently rotating wheels to achieve a combination of speeds and motions in which drive forces are applied in a manner that, in an aggregate, provide rotational and translational motion in any direction along a plane of the sheet. In this manner, sheet position can be controlled in the process direction, a lateral direction and an angular position.

Exemplary embodiments may employ three or more omni-directional wheel components set up such that sheets can be offset and registered in the stacker without ever losing physical control of the set.

Exemplary embodiments may effectively replace the functions of the scuffer and side tampers in controlling set and stack registration in an image forming device. In embodiments, sheets may be driven into a respective registration wall corner for inboard or outboard offset. The corner may be positioned to a correct location based on a sheet width. After a set is complete, it will be ejected onto the stack/tray. In alternative embodiments, the sheets could be driven to the same registration corner with the corner being moved laterally to accommodate offsetting.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for improving stack registration with regard to sets of image receiving media substrates at an output of an image receiving media processing or post-processing unit in an image forming device by employing a plurality of omni-directional wheeled device structures to implement substrate support and substrate set alignment in two dimensions, will be described, in detail, with reference to the following drawings, in which.

DETAILED DESCRIPTION OF THE DISCLOSED EMBODIMENTS

Figure 1:
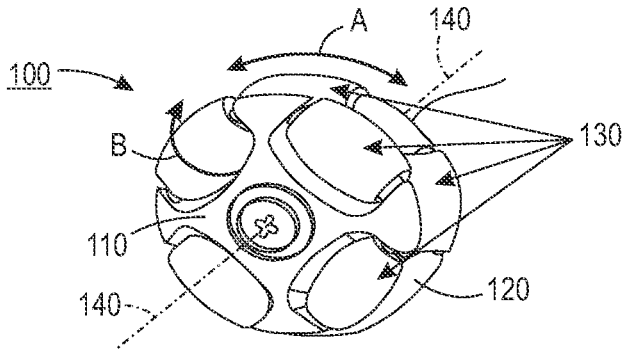
FIG. 1 illustrates an exemplary embodiment of an omni-directional wheeled device for use in the systems and methods according to this disclosure.

The systems and methods for improving stack registration with regard to sets of image receiving media substrates at an output of an image receiving media processing or post-processing unit in an image forming device by employing a plurality of omni-directional wheeled device structures to implement substrate support and substrate set alignment in two dimensions, according to this disclosure, will generally refer to this specific utility, configuration or function for those systems and methods. Exemplary embodiments described and depicted in this disclosure should not be interpreted as being specifically limited to any particular configuration of the described elements except insofar as individual omni-directional wheeled devices may be configured to provide traction for movement in a first direction (generally the direction of rotation of the devices by their respective motors, and freedom of movement in a second direction, which is orthogonal to the first direction in support of set compiling functions. Further, exemplary embodiments described and depicted in this disclosure should not be interpreted as being specifically directed to any particular intended use, including any particular functioning or operation of a processing, post-processing or other component device in an image forming system in which elements of the disclosed image receiving media transport systems may be advantageously employed.

Specific reference to, for example, various configurations of image forming systems and component devices within those systems, including post-processors and/or compilers, as those concepts and related terms are captured and used throughout this disclosure, should not be considered as limiting those concepts or terms to any particular configuration of the respective devices, the system configurations or the individual elements. The subject matter of this disclosure is intended to broadly encompass systems, devices, schemes and elements that may involve image forming and finishing operations, as those operations would be familiar to those of skill in the art. The disclosed concepts are particularly adapted to providing one or more image receiving media substrate movement support systems in appropriate image receiving media transport paths, the movement support systems being uniquely configured to incorporate an operating device that is configured with a plurality of independently-powered omni-directional wheeled devices.

The disclosed embodiments may specifically address shortfalls in conventional compilers in which compiled stack integrity is often compromised, particularly as speeds of image receiving media substrate through put increase, introducing errors in the stacking and registration processes where lower sheets are often caused to migrate, or to "walk back," leading to errors in in-set registration in the process direction.

The disclosed embodiments may provide uniquely configured rotating structures, pluralities of which may be configured to provide even support for sheets of image receiving media in a compiler system. The particularly-configured set of rotating components may aid in reducing a tendency of lower sheets to migrate in a registration process, thereby thwarting the intent of the registration process requiring additional mechanical movements rather than fewer. In operation, as will be particularly shown with reference to FIGS. 4 and 5, the operating device(s) configured with a plurality of independently-powered omni-directional wheeled devices will be correctly positioned to implement substrate support with the plurality of throughout a compiling operation before depositing compiled sets of image receiving media substrates onto a main internal set processing tray for further processing or output.

In certain conventional image forming systems, image receiving media substrates may enter what is conventionally understood to be a finishing/stacking portion via a vacuum transport mechanism in which a lead edge of a processed image receiving media substrate is adhered to the transport mechanism and the trail edge remains free to "float." The individual sheets of image receiving media substrates may then be stripped off and guided to a registration edge in an output position with respect to an exit/ejection port (or output throat) of an image receiving media processing or post-processing unit. A scuffer may nudge the individual sheets of image receiving media substrates against the registration edge. The individual sheets of image receiving media substrate may be lifted slightly as side tampers tamp the sheets or compiling sets with the scuffer disengages. Additional sheets, as the set is compiled, may come in on top of the supported sheets as the cycle is repeated.

FIG. 1 illustrates an exemplary embodiment of an omni-directional wheeled device 100 for use in the systems and methods according to this disclosure. As shown in FIG. 1, the exemplary omni-directional wheeled device 100 may be constituted of a plurality of central body portions 110,120 that are generally rotatable about an axis 140 in directions A. The plurality of central body portions 110,120 may each support, about their outer peripheries, a plurality of freely rotating staggered roller components 130, which are rotatable in direction B. In this manner, as the omni-directional wheeled device 100 is rotated in directions A, the plurality of freely rotating staggered roller components 130 will generate a traction against a surface of an image receiving media substrate in order to impart some motion to the image receiving media substrate. The freely rotating nature of the staggered roller components in direction B allows the substrate to translate in that direction essentially unimpeded.

In other words, the particular configuration of the exemplary omni-directional wheeled device 100 provides drive (fraction) normal to the motor axis 140 while allowing sliding in the motor axis direction, i.e., drive in the same manner as regular wheel, but are able to slide freely in the perpendicular direction.

Figure 2:
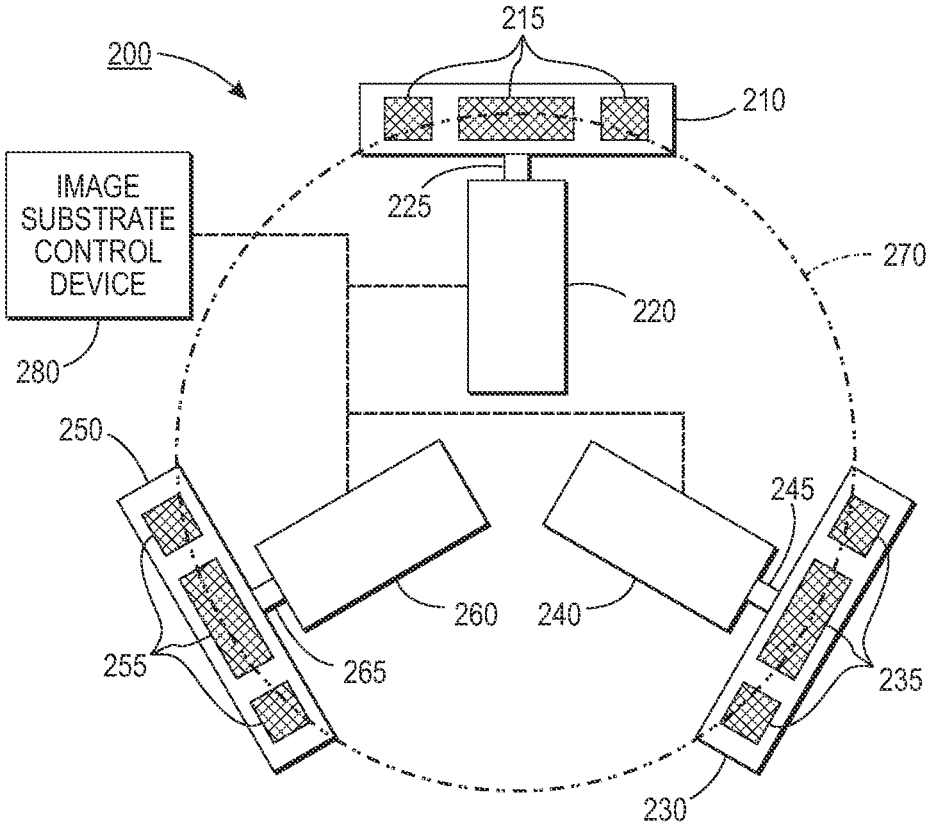
FIG. 2 illustrates a simple schematic representation of a plan view of an operating device that is configured with a plurality of independently-powered omni-directional wheeled devices according to this disclosure.

FIG. 2 illustrates a simple schematic representation of a plan view of an operating device 200 that is configured with a plurality of independently-powered omni-directional wheeled devices that may be configured as the exemplary omni-directional wheeled device 100 shown in FIG. 1. In an exemplary embodiment, three independent omni-directional wheeled devices 210,230,250 may be arranged with substantially 120° separation on a nominal circle 270 as a wheel baseline. Each of the three independent omni-directional wheeled devices 210,230,250 may be similarly or identically configured to include a respective plurality of freely rotating staggered roller components 215,235,255. Each of the three independent omni-directional wheeled devices 210,230,250 may be independently driven by a respective motor 220,240,260 via a motor axis 225,245,265, the respective motor(s) 220,240,260 receiving substrate translation commands or signals from an image substrate control device 280 which may be a standalone device, or otherwise may be a function of a processor in, or associated with, the image forming system with which the operating device 200 is also associated.

The image substrate control device 280 may generate independent signals for the movement of a sheet of image receiving media substrate according to pre-determined or sensed conditions of the positioning of the sheet of image receiving media substrate. In this manner, as will be described in greater detail below, when using three or more independent omni-directional wheeled devices 210,230,250, translational movement can be combined with rotation to deliver the sheet of image receiving media substrate at a correct angle and lateral position. This controlled angular and positional movement may be achieved by independently rotating the omni-directional wheeled devices 210,230,250 to achieve a combination of speeds. The drive forces may be added to provide rotational and translational motion in any direction along a plane of the sheet of image receiving media substrate. Sheet position can be controlled in the process direction, the lateral direction and according to an angular position. The disclosed embodiments are not limited to only three independently rotating the omni-directional wheeled devices 210,230,250. Rather, the disclosed concepts may employ three or more omni-directional wheeled devices arranged such that sheets of image receiving media can be offset and registered in a stacker without ever losing control of the set. This multiple wheeled device configuration may effectively replace the conventional scuffer and side tampers in a manner that still supports the functions of those components.

Figure 3:
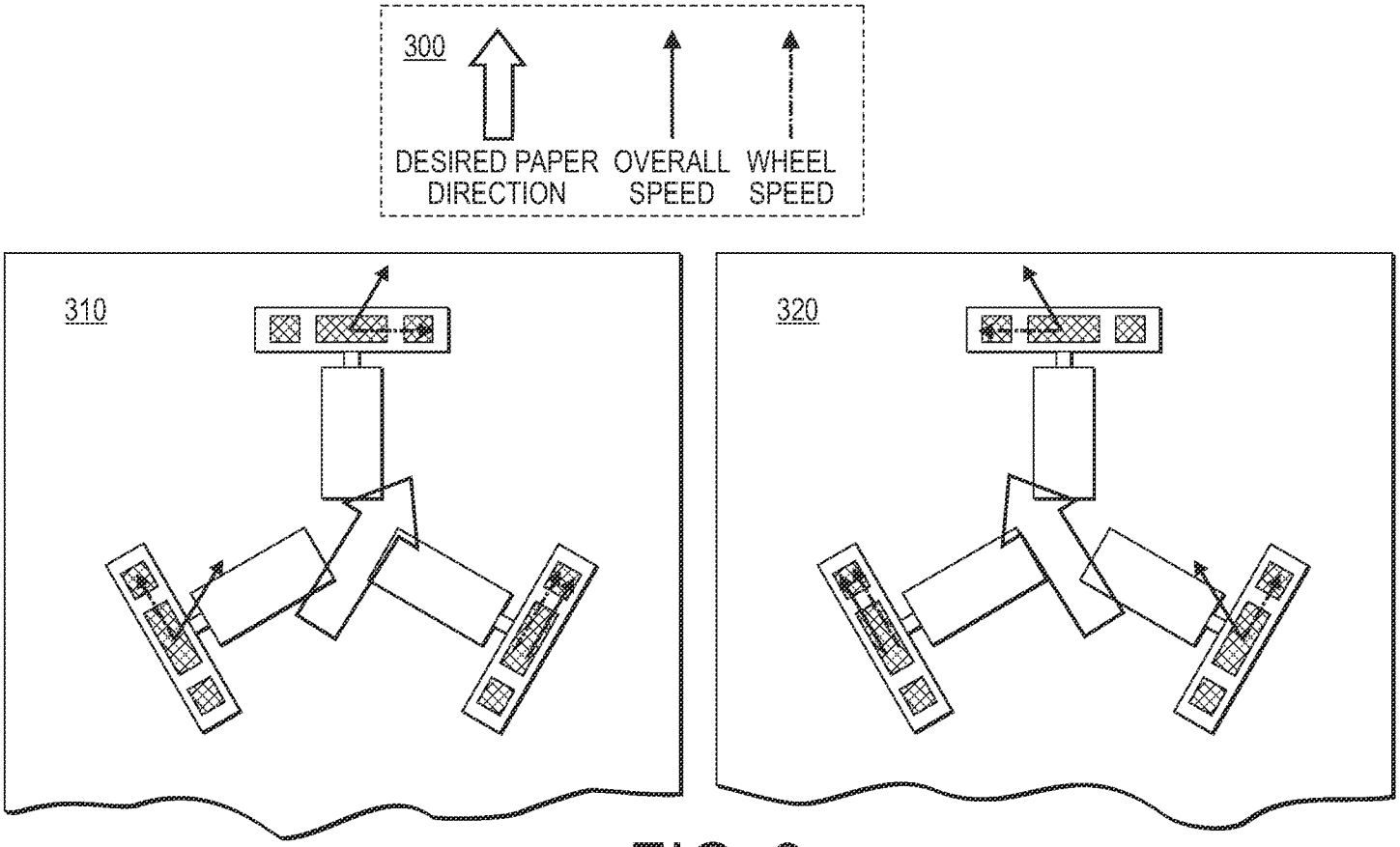
FIG. 3 illustrates a first operating overview of the exemplary operating device shown in FIG. 2 for achieving precision control of sheets of image receiving media substrates in support of precise registration according to this disclosure.
Figure 4:
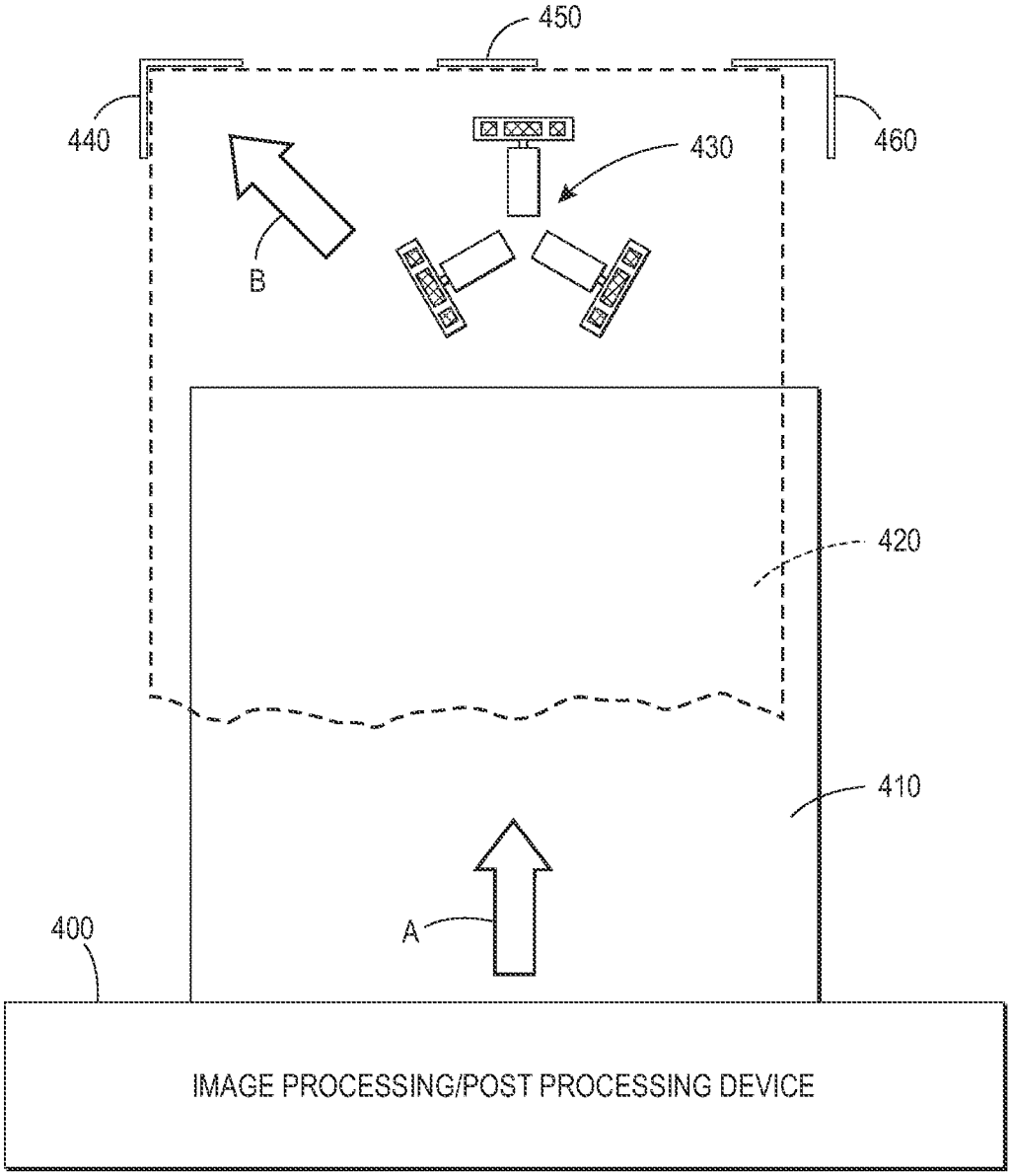
FIG. 4 illustrates a second operating overview of the exemplary operating device shown in FIG. 2 for achieving precision control of sheets of image receiving media substrates in support of precise registration according to this disclosure.

FIG. 3 illustrates a first operating overview of the exemplary operating device shown in FIG. 2 for achieving precision control of sheets of image receiving media substrates in support of precise registration. With reference to the legend 300, FIG. 3 2 illustrates examples 310,320 of possible movements achieved by the net effect of the individual wheel speeds. FIG. 4 illustrates a second operating overview of the exemplary operating device shown in FIG. 2 for achieving precision control of sheets of image receiving media substrates in support of precise registration. As shown in FIG. 4, a sheet may be translated from a first position 410 exiting an image processing/post-processing device 400 at an output throat in a direction A to a second position 420, which overlies the operating device 430. The sheet may be driven into a respective registration wall/wall corner 440,450,460 for inboard (440) or outboard (460) offset. The wall corner 440, 460 may be positioned to a correct location depending on a sheet width. After a set is complete in this manner, it may be ejected onto a stack/tray.

Among the objectives achieved by the disclosed configurations may be a unique advantage in that movement of sheets of image receiving media substrates, as they are accumulated in sets are positively controlled. Any tendency of sheets of image receiving media substrates to migrate away from a registration wall, registration corner or other alignment component, due to any slope being caused by the presence of, for example, stepped surfaces, may be substantially eliminated.

Although depicted somewhat precisely in FIGS. 1-4, the described and depicted embodiments are intended to be illustrative of the inventive concept and not limiting as to the configurations of the operating devices comprising a plurality of independently-powered omni-directional wheeled devices, or to the configurations of the independently-powered omni-directional wheeled devices. Those of skill in the art will recognize that the operating devices should likely comprise at least three independently-powered omni-directional wheeled devices to effect the translation of the image receiving media substrates in a process direction, in a cross-process direction and in skew.

Figure 5:
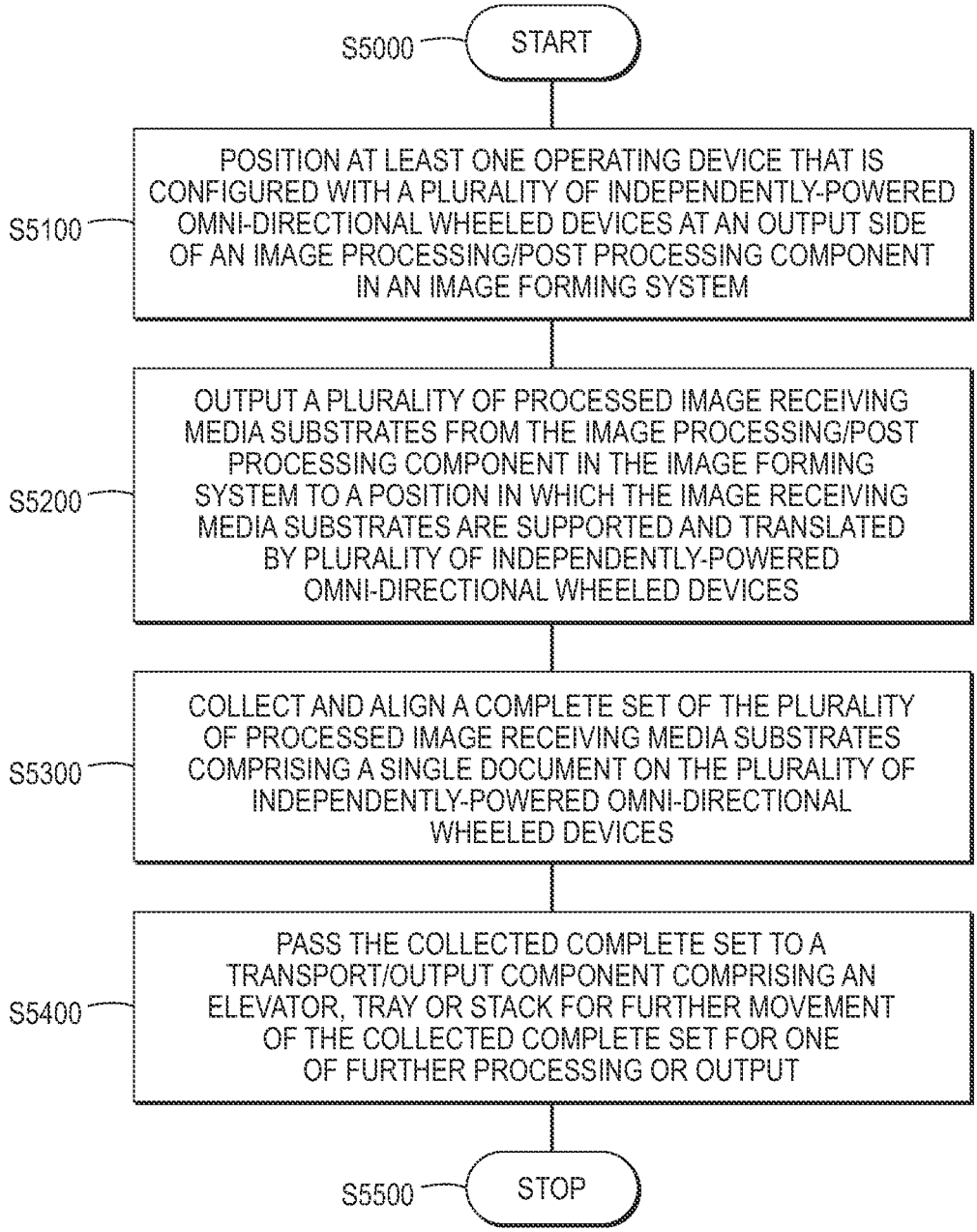
FIG. 5 illustrates a flowchart of an exemplary method for implementing a process for image receiving media transport in a particularly-configured compiler/elevator section by employing an operating device that is configured with a plurality of independently-powered omni-directional wheeled devices according to this disclosure.

The disclosed embodiments may include a method for implementing a process for image receiving media transport in a particularly-configured compiler/elevator section by employing an operating device that is configured with a plurality of independently-powered omni-directional wheeled devices. FIG. 5 illustrates a flowchart of such an exemplary method. As shown in FIG. 5, operation of the method commences at Step S5000 and proceeds to Step S5100.

In Step S5100, at least one operating device may be provided that is configured with a plurality of independently-powered omni-directional wheeled devices, and positioned at an output side of an image processing and/or post processing component in an image forming system. Operation of the method proceeds to Step S5200.

In Step S5200, a plurality of processed image receiving media substrates may be output in order from the image receiving media processing and/or post processing component in the image forming system to a position in which the image receiving media substrates are generally supported on, and translated by, the plurality of. the substantially-parallel top (supporting) portions of the uniquely-portioned top surfaces of the plurality of independently-powered omni-directional wheeled devices. Operation of the method proceeds to Step S5300.

In Step S5300, a complete set of the plurality of processed image receiving media substrates comprising a single document, according to a single print job assignment in the image forming system, may be collected and aligned on the plurality of independently-powered omni-directional wheeled devices. Operation of the method proceeds to Step S5400.

In Step S5400, the collected complete set of image receiving media substrates may be passed to a transport/output component comprising an elevator, tray or stack for further movement of the collected complete set for one of further processing or output. Operation of the method proceeds to Step S5500, where operation of the method ceases.

The above-described exemplary systems and methods reference certain conventional components to provide a brief, general description of suitable document processing and post-processing means by which to carry out the disclosed image receiving media transport techniques in support of obtained image forming operations in the described image forming devices and systems. Those skilled in the art will appreciate that other embodiments of the disclosed subject matter may be practiced with many types and configurations of individual devices and combinations of devices particularly common to image forming and post-processing of image formed products in image forming devices and systems of varying complexity. No particular limitation to the variety or configuration of individual component devices included in image forming systems of varying complexity is to be inferred from the above description.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 5, and the accompanying description, except where a particular method step is a necessary pre-condition to execution of any other method step. Individual method steps may be carried out in sequence or in parallel in simultaneous or near simultaneous timing, as appropriate.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various alternatives, modifications, variations, or improvements therein may be subsequently made by those skilled in the art, which are also intended to be encompassed by the following claims.

We claim:

1. A method for handling image receiving media substrates in an image forming system, comprising:

providing a substrate handling device as a transport mechanism for collecting and registering a set of processed image receiving media substrates exiting an output of an image receiving media substrate processing device, the substrate handling device comprising:

a plurality of omni-directional wheeled devices that collectively form a substrate collection and handling surface for processed image receiving media substrates exiting the output of the image receiving media substrate processing device, and a plurality of independent motors respectively and independently controlling a rotation each of the plurality of omni-directional wheeled devices, receiving, with the substrate handling device, a plurality of processed image receiving media substrates exiting the output of the image receiving media substrate processing device; and operating the substrate handling device to translate the plurality of processed image receiving media substrates in at least one of the process direction, a cross process direction and angular skew based on individual speeds of the plurality of independent motors.

2. The method of claim 1, at least one of the plurality of omni-directional wheeled devices being configured to apply a traction force in a direction of rotation of the at least one omni-directional wheeled and to allow sliding in a direction orthogonal to the direction of rotation.

3. The method of claim 2, the at least one of the plurality of omni-directional wheeled devices, comprising:

a main body component that presents a substantially circular outer profile;

a receiver portion in a physical center of the main body component that receives one end of a motor shaft, the motor shaft being connected at another end to one of the plurality of independent motors, the one of the plurality of independent motors rotating the main body component in directions corresponding to the substantially circular outer profile;

a plurality of roller components that are (1) mounted at an outer periphery of the main body component with an outer profile that conform in part to the substantially circular outer profile of the main body component, and (2) configured as rotating bodies that rotate in a direction orthogonal to the rotation of the main body component while providing a plurality of traction surfaces in a direction of rotation of the main body component about the motor shaft.

4. The method of claim 1, further comprising:

determining a position of processed image receiving media substrates exiting the output of the image receiving media substrate processing device; and providing control signals to each of the plurality of independent motors to translate the plurality of processed image receiving media substrates in the at least one of the process direction, the cross process direction and angular skew.

5. The method of claim 1, further comprising providing a registration alignment component in a vicinity of the substrate handling device, the substrate handling device being operated to translate the plurality of processed image receiving media substrates in the at least one of the process direction, the cross process direction and angular skew to effect alignment of the plurality of processed image receiving media substrates against the registration alignment component.

6. The method of claim 5, the registration alignment component being one of a registration wall component or a registration corner component.

7. The method of claim 5, further comprising moving the registration alignment component based on a size of a sheet of the processed image receiving media substrates.

8. The method of claim 1, the substrate handling device being comprised of three omni-directional wheeled devices arranged at substantially 120° relative to one another in a plane when viewed from a position orthogonal to the plane, a combination of traction forces independently applied by the three omni-directional wheeled devices controlled by three independent motors causing the controlled translation of the plurality of processed image receiving media substrates.

9. The method of claim 1, further comprising operating the substrate handling device to pass an assembled and aligned set of processed image receiving media substrates downstream in the process direction to be deposited onto one of a stack or elevator for further processing.

10. A substrate handling device for use in an image forming system, comprising:

a plurality of omni-directional wheeled devices that collectively form a substrate collection and handling surface for image receiving media substrates;

a plurality of independent motors respectively and independently controlling a rotation each of the plurality of omni-directional wheeled devices; and a motor control device that sends signals to each of the plurality of independent motors to operate the each of the plurality of independent motors at individual speeds for the each of the plurality of independent motors, the substrate handling device being positioned downstream in a process direction at an output of an image receiving media substrate processing device in the image forming system as a transport mechanism for collecting and registering a set of processed image receiving media substrates exiting the output of the image receiving media substrate processing device.

11. The substrate handling device of claim 10, at least one of the plurality of omni-directional wheeled devices being configured to apply a traction force in a direction of rotation of the at least one omni-directional wheeled and to allow sliding in a direction orthogonal to the direction of rotation.

12. The substrate handling device of claim 11, the at least one of the plurality of omni-directional wheeled devices, comprising:

a main body component that presents a substantially circular outer profile;

a receiver portion in a physical center of the main body component that receives one end of a motor shaft, the motor shaft being connected at another end to one of the plurality of independent motors, the one of the plurality of independent motors rotating the main body component in directions corresponding to the substantially circular outer profile;

a plurality of roller components that are (1) mounted at an outer periphery of the main body component with an outer profile that conforms in part to the substantially circular outer profile of the main body component, and (2) configured as rotating bodies that rotate in a direction orthogonal to the rotation of the main body component while providing a plurality of traction surfaces in a direction of rotation of the main body component about the motor shaft.

13. The substrate handling device of claim 10, the motor control device receiving information on a position of the processed image receiving media substrates exiting the output of the image receiving media substrate processing device; and providing the signals to the each of the plurality of independent motors to based on the received information.

14. The substrate handling device of claim 10, wherein:

a registration alignment component is provided in a vicinity of the substrate handling device in the image forming system; and the substrate handling device is operated to translate the plurality of processed image receiving media substrates in the at least one of the process direction, the cross process direction and angular skew to effect alignment of the plurality of processed image receiving media substrates against the registration alignment component.

15. The substrate handling device of claim 10, the substrate handling device being comprised of three omni-directional wheeled devices arranged at substantially 120° relative to one another in a plane when viewed from a position orthogonal to the plane, a combination of traction forces independently applied by the three omni-directional wheeled devices controlled by three independent motors causing the controlled translation of the plurality of processed image receiving media substrates.

16. An image forming system, comprising:

at least one image receiving media substrate processing or post-processing device;

a substrate handling device positioned downstream of the at least one image receiving media processing or post-processing device in a process direction, the substrate handling device providing a transport mechanism for collecting and registering a set of processed image receiving media substrates exiting an output of the at least one image receiving media substrate processing or post-processing device, the substrate handling device comprising:

a plurality of omni-directional wheeled devices that collectively form a substrate collection and handling surface for the image receiving media substrates, and a plurality of independent motors respectively and independently controlling a rotation of each of the plurality of omni-directional wheeled devices;

a processor that is programmed to (1) determine a position of processed image receiving media substrates exiting the output of the at least one image receiving media substrate processing or post-processing device, and (2) provide signals to the plurality of independent motors to control a rotation of each of the plurality of omni-directional wheeled devices;

a registration alignment component in a vicinity of the substrate handling device; and a processing tray or elevator positioned downstream of the substrate handling device, the substrate handling device being operated to translate the plurality of processed image receiving media substrates in at least one of the process direction, a cross process direction and angular skew to effect alignment of the plurality of processed image receiving media substrates against the registration alignment component, and pass an assembled and aligned set of processed image receiving media substrates downstream in the process direction to be deposited onto the processing tray or elevator for further processing.

17. The image forming system of claim 16, at least one of the plurality of omni-directional wheeled devices being configured to apply a traction force in a direction of rotation of the at least one omni-directional wheeled and to allow sliding in a direction orthogonal to the direction of rotation.

18. The image forming system of claim 17, the at least one of the plurality of omni-directional wheeled devices, comprising:

a main body component that presents a substantially circular outer profile;

a receiver portion in a physical center of the main body component that receives one end of a motor shaft, the motor shaft being connected at another end to one of the plurality of independent motors, the one of the plurality of independent motors rotating the main body component in directions corresponding to the substantially circular outer profile;

a plurality of roller components that are (1) mounted at an outer periphery of the main body component with an outer profile that conforms in part to the substantially circular outer profile of the main body component, and (2) configured as rotating bodies that rotate in a direction orthogonal to the rotation of the main body component while providing a plurality of traction surfaces in a direction of rotation of the main body component about the motor shaft.

19. The image forming system of claim 16, the registration alignment component being one of a registration wall component or a registration corner component.

20. The image forming system of claim 19, the registration alignment component being movable based on a size of a sheet of the processed image receiving media substrates.

21. The image forming system of claim 16, the substrate handling device being comprised of three omni-directional wheeled devices arranged at substantially 120° relative to one another in a plane when viewed from a position orthogonal to the plane, a combination of traction forces independently applied by the three omni-directional wheeled devices controlled by three independent motors causing the controlled translation of the plurality of processed image receiving media substrates.

* * * * *